US009427610B2

(12) United States Patent
Ringer et al.

(10) Patent No.: US 9,427,610 B2
(45) Date of Patent: Aug. 30, 2016

(54) DRY SPRINKLERS WITH MULTIPLE COUPLING ARRANGEMENTS

(75) Inventors: Yoram Ringer, Providence, RI (US); Manuel R. Silva, Jr., Cranston, RI (US); George B. Coletta, West Warwick, RI (US); Roger H. Leduc, Pascoag, RI (US); Sean D. Weed, Warwick, RI (US)

(73) Assignee: Tyco Fire Products LP, Lansdale, PA (US)

( * ) Notice: Subject to any disclaimer, the term of this patent is extended or adjusted under 35 U.S.C. 154(b) by 170 days.

(21) Appl. No.: 13/877,439

(22) PCT Filed: Jun. 28, 2012

(86) PCT No.: PCT/US2012/044621

§ 371 (c)(1),
(2), (4) Date: Jun. 5, 2013

(87) PCT Pub. No.: WO2013/003577

PCT Pub. Date: Jan. 3, 2013

(65) Prior Publication Data

US 2014/0096981 A1 Apr. 10, 2014

Related U.S. Application Data

(60) Provisional application No. 61/501,959, filed on Jun. 28, 2011.

(51) Int. Cl.
*A62C 35/62* (2006.01)
*A62C 35/68* (2006.01)

(52) U.S. Cl.
CPC ..... *A62C 35/62* (2013.01); *A62C 35/68* (2013.01); *Y10T 29/49826* (2015.01)

(58) Field of Classification Search
CPC ..... A62C 35/62; A62C 35/68
USPC ..... 239/16, 17, 37
See application file for complete search history.

(56) References Cited

U.S. PATENT DOCUMENTS

| | | | | |
|---|---|---|---|---|
| 2,180,258 | A | 11/1939 | Rowley | |
| 2,211,399 | A | 8/1940 | Winslow | |
| 2,229,183 | A | 8/1942 | Knight | |
| 2,291,818 | A | 8/1942 | Loepsinger | |
| 2,768,696 | A | 10/1956 | Sherburne | |
| 2,871,953 | A | 2/1959 | Bray | |
| 3,007,528 | A | 11/1961 | Gloeckler | |
| 3,061,015 | A | 10/1962 | Cann, Jr. | |
| 3,080,000 | A | 3/1963 | Gloeckler | |
| 3,584,689 | A | 6/1971 | Willms | |
| 4,007,877 | A * | 2/1977 | Jackson | B05B 15/069 169/37 |
| 4,007,878 | A | 2/1977 | Anderson | |
| 4,083,410 | A * | 4/1978 | Anderson | A62C 37/10 169/37 |
| 4,091,872 | A | 5/1978 | Mountford | |
| 4,177,862 | A | 12/1979 | Bray | |
| 4,220,208 | A | 9/1980 | Jackson et al. | |

(Continued)

OTHER PUBLICATIONS

U.S. Appl. No. 61/501,959, filed Jun. 28, 2011, Coletta et al.

(Continued)

*Primary Examiner* — Len Tran
*Assistant Examiner* — Alexander Valvis
(74) *Attorney, Agent, or Firm* — Perkins Coie LLP

(57) ABSTRACT

A dry sprinkler for a fire protection system having multiple alternative coupling arrangements for connection to the fluid supply piping of the system.

19 Claims, 4 Drawing Sheets

(56) References Cited

U.S. PATENT DOCUMENTS

| | | | | |
|---|---|---|---|---|
| 4,228,858 | A | 10/1980 | Sclafani | |
| 4,417,626 | A | 11/1983 | Hansen | |
| 4,582,347 | A | 4/1986 | Wilcox et al. | |
| 4,712,812 | A | 12/1987 | Weir | |
| 4,923,013 | A * | 5/1990 | De Gennaro | A62C 35/68 169/37 |
| 5,110,160 | A † | 5/1992 | Brozovic | |
| 5,188,185 | A | 2/1993 | Mears | |
| 5,228,520 | A | 7/1993 | Gottschalk | |
| 5,415,239 | A | 5/1995 | Kotter et al. | |
| 5,775,431 | A | 7/1998 | Ondracek | |
| 5,967,240 | A | 10/1999 | Ondracek | |
| 6,851,482 | B2 | 2/2005 | Dolan | |
| 7,516,800 | B1 † | 4/2009 | Silva | |
| 7,559,376 | B2 | 7/2009 | Silva, Jr. | |
| 7,766,252 | B2 † | 8/2010 | Jackson | |
| 8,225,881 | B2 | 7/2012 | Silva, Jr. | |
| 8,327,946 | B1 | 12/2012 | Silva, Jr. et al. | |
| 8,469,112 | B1 | 6/2013 | Silva, Jr. et al. | |
| 8,528,653 | B1 | 9/2013 | Silva, Jr. et al. | |
| 8,636,075 | B2 † | 1/2014 | Franson | |
| 8,746,356 | B1 | 6/2014 | Silva, Jr. et al. | |
| 8,826,998 | B2 | 9/2014 | Silva, Jr. | |
| 2003/0075343 | A1 | 4/2003 | Ballard | |
| 2007/0187116 | A1 | 8/2007 | Jackson et al. | |
| 2009/0101367 | A1 | 4/2009 | Healy | |
| 2014/0102729 | A1 | 4/2014 | Ringer et al. | |

OTHER PUBLICATIONS

Dry Pendent Drop Sprinkler, Data Sheet AS 1.59, Date Unknown, (2 pages).
Engineering Drawings of the Dry Pendent Drop Sprinkler described in Data Sheet AS 159; Date Unknown, (10 pages).
Victaulic. Models V3604 and V3603 Dry Type Upright—Standard and Quick Response, 4 sheets, Apr. 2001.
Viking Corp., Technical Data, "Dry Pendent Sprinklers Model C" Jan. 1987 ( 4 pages).
Chemetron Fire Systems, Model ME-1 Flush Type Dry Pendent:, Date Unknown, (4 pages).
Total Walther Feuerschutz GmbH, Hängender Trockensprinkler GHTS 15, Dry Pendent Sprinkler anti-gel Kenblatt-Nr. 4-044-03, Jan. 1989. (2 pages).
Reliable. "Model G3 Dry Sprinkler", Nov. 1987. (4 pages).
Victaulic. Models V3608 and V3607 Standard Spray Pendent and Recessed Pendent Standard and Quick Response, Apr. 2001. (4 pages).
Globe Fire Sprinkler Corporation, "Automatic Sprinklers Model J Bulb Spray Series Dry Type Pendent Recessed Pendent", Aug. 1990. (8 pages).
Globe Fire Sprinkler Corporation, "Dry Pendent Sprinklers Model F960 Designer. 1/2 Orifice", Feb. 2001. (4 pages).
Central Sprinkler Corporation, "Dry Pendent Sprinklers Recessed, Flush and Extended Types Model "A-1", 1986. (2 pages).
Preussag Minimax "Sprinkler-Teile/Parts Trockensprinkler dry sprinkler", Jan. 1989. (2 pages).
Tyco DS-Jul. 1, 2001 Datasheets (TFP500, TFPS10, TFP520) (30 pages).
Tyco DS-Oct. 2, 2001 Datasheets (TFP530, TFP540) (30 pages).
Grinnell Corporation; Dry Sprinklers, Quick Response, Data Sheet of Model F960; Jun. 1998; 1 sheet.
Grinnell Corporation; Engineering drawings of Model F960 Dry Pendent Bulb Type Sprinkler Yoke; Rev. Jan. 3, 1991: 1 sheet.
Grinnell Corporation; Engineering drawings of Model F960 Dry Pendent BulbType Sprinkler Assembly; Apr. 24, 1991; 1 sheet.
Viking Corp.: Technical Data, "Model M Quick Response Dry Pendent Sprinkler"; Apr. 9, 1998; 4 sheets.
Factory Mutual Research Corporation; "Approval Standard for Automatic Sprinklers for Fire Protection, Class Series 2000" (Sections 4.8 and 4.13); May 1998; 5 pages.
Underwriters Laboratories Inc.; "UL 199 Standard for Automatic Sprinklers for Fire-Protection Service" (Sections 20 and 29); Apr. 8, 1997: 4 pages.
James E. Golinveaux; "A Technical Analysis: The Use and Maintenance of Dry Type Sprinklers" (http://www.tyco-fire.com1TFP_common/DrySprinklers.pdf); Jun. 2002; (15 pages).
Victaulic; "Models V3606 and V3605 Dry Type Standard Spray Pendent and Recessed Pendent Standard and Quick Response"; 2002:4 sheets.
U.S. Appl. No. 61/501,959, filed Jun. 28, 2011.
International Search Report for PCT/US2012/044621 (Form PCT/ISA/210), Jan. 25, 2013, 3 pages.
Written Opinion of the International Searching Authority for PCT/US2012/044621 (Form PCT/ISA/237), Jan. 25, 2013, 7 pages.
Viking Technical Data ESFR Dry Pendent Sprinkler VK501 (K14. 0,pp. 122a-122h,May 2, 2011,The viking Corporation, Hastings, MI, https://web.archive.org/web/20111004195717/http://www.vikinggroupinc.com/databook/sprinklers/storage/050707.pdf.†

* cited by examiner
† cited by third party

DRY SPRINKLERS WITH MULTIPLE COUPLING ARRANGEMENTS

PRIORITY CLAIM & INCORPORATION BY REFERENCE

This application is a 35 U.S.C. §371 application of International Application No. PCT/US2012/044621 filed Jun. 28, 2012, which claims the benefit of priority to U.S. Provisional Patent Application No. 61/501,959, filed Jun. 28, 2011, each of which is incorporated by reference in its entirety.

BACKGROUND OF THE INVENTION

Dry sprinklers may be used in wet or dry pipe fire protection systems. In a wet-pipe fire protection system, all the system pipes contain water for immediate release through any sprinkler that is activated. In a dry-pipe fire protection system, branch lines and other distribution pipes may contain a dry gas (air or nitrogen) under pressure. Once activated, the dry sprinklers distribute fire-extinguishing fluid, preferably water, in the room or building. Industry accepted standards, such as for example, the National Fire Protection Association (NFPA) standard entitled, "NFPA 13: Standards for the Installation of Sprinkler Systems" (2010 ed.) ("NFPA 13") defines a dry sprinkler as a "sprinkler secured in an extension nipple that has a seal at the inlet end to prevent water from entering the nipple until the sprinkler operates." Known dry sprinklers generally include an inlet containing a seal or closure assembly, some length of tubing connected to the inlet, and a fluid deflecting structure located at the other end of the tubing.

The fluid supply for a sprinkler system may include, for example, an underground water main that supplies a vertical riser having a piping distribution network atop the riser with branch lines that carry the pressurized supply fluid to the sprinklers. The inlet of the sprinkler may be secured to a branch line by one of a threaded coupling or a clamp coupling. An exemplary known dry sprinkler is shown and described in U.S. Published Patent Application No. 2007/0187116 to Jackson et al. There exists a need for a single dry sprinkler having multiple alternative coupling arrangements. Moreover, there is a need for the alternative coupling arrangements to be able to connect to standard pipe fittings, i.e., T-fittings, pipe nipples, pipe reducers, etc, that may be encountered in either a wet or dry sprinkler system.

SUMMARY OF THE INVENTION

The present invention provides dry sprinkler sprinklers, systems and methods having an inlet fitting with multiple alternative coupling arrangements for connection to the fluid supply piping of the system. One particular embodiment provides for a dry sprinkler having a dual connection inlet fitting that includes an external thread for a threaded-type coupling connection and an external groove for a groove-type coupling connection. One embodiment of the dry sprinkler includes an outer structural assembly having a proximal inlet, a distal outlet, and an internal passageway extending between the inlet and the outlet defining a longitudinal axis of the sprinkler. The preferred outer structural assembly includes an inlet fitting including a proximal head portion and a distal body portion, the head portion having an external thread defining an external thread diameter. In one preferred aspect, the body portion includes an external groove defining a nominal diameter of the body portion being greater than the nominal external thread diameter. The external thread and groove provide the sprinkler with alternate threaded and grooved coupling arrangements for connection to a fluid supply pipe. The inlet fitting has an internal surface defining a sealing surface of the dry sprinkler. An outlet frame includes a deflector axially spaced at a fixed distance from the outlet; and a casing tube is disposed between the inlet fitting and an outlet frame. A seal assembly is disposed along the passageway for sealing the sprinkler inlet fitting.

The present invention provides a preferred method, system and apparatus for coupling a dry sprinkler to a fluid supply pipe. The method preferably includes disposing an inlet fitting of the dry sprinkler along the fluid supply pipe, the inlet fitting having a proximal head portion and a distal body portion. A preferred dry sprinkler system and method of coupling provides that the dry sprinkler has an inlet fitting, an outlet frame and a casing tube between the inlet fitting and the outlet frame to define a passageway of the sprinkler. The preferred inlet fitting includes a proximal head portion and a distal body portion with a pipe transition portion between the proximal head and distal body portions. The head portion has an external thread, the body portion including an external groove, and the sprinkler includes an internal assembly to seal the passageway at the inlet fitting. The preferred system and method provides one of a threaded connection and a grooved-type coupling connection between the inlet fitting and the fluid supply pipe fitting. In the threaded connection, the fluid supply pipe fitting is a nominally sized internally threaded fitting with the external threads being threaded into the threaded pipe fitting. In the grooved-type coupling connection, the fluid supply pipe fitting is a grooved fitting defining a nominal sized pipe groove coupled to the external groove of the inlet fitting with the external thread being substantially disposed within the grooved fitting.

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE PREFERRED EMBODIMENTS

Figure 1:
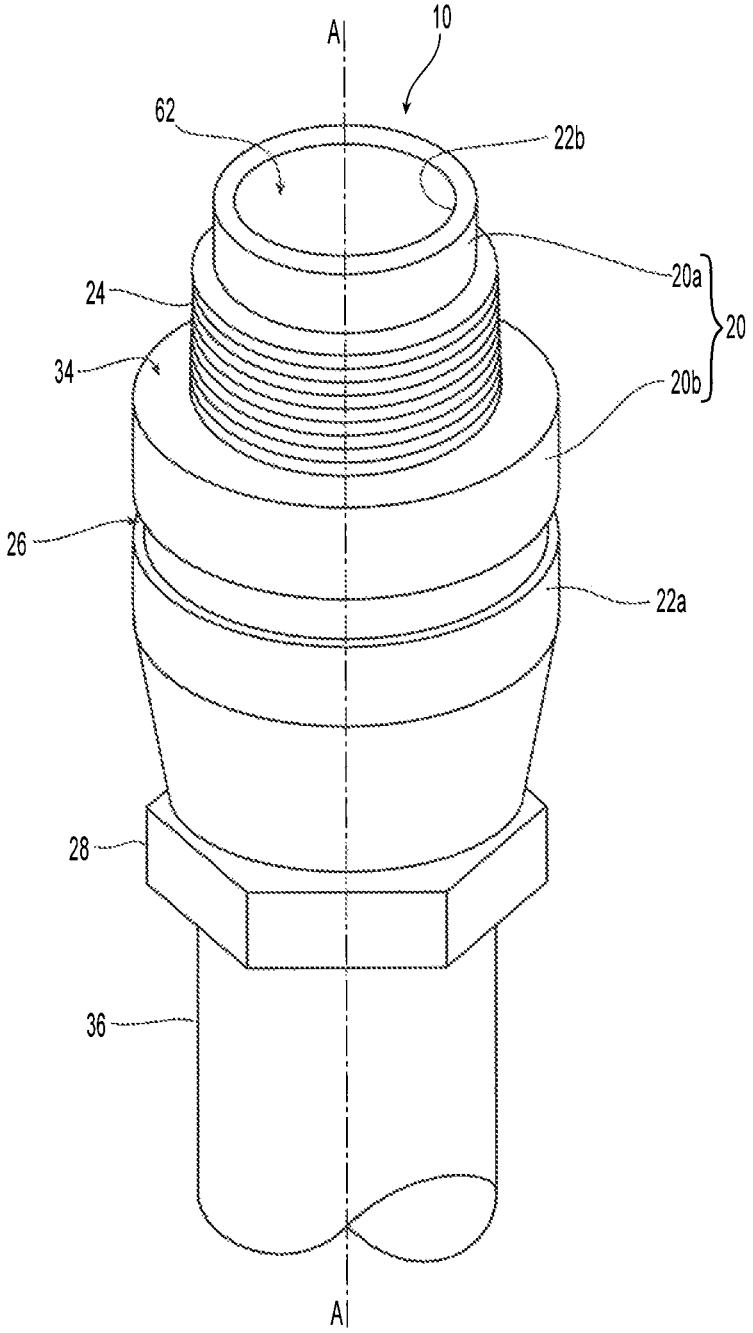
FIG. 1 is a partial perspective view of the preferred dry sprinkler used in the installation connections of FIGS. 1A and 1B.
Figure 1A:
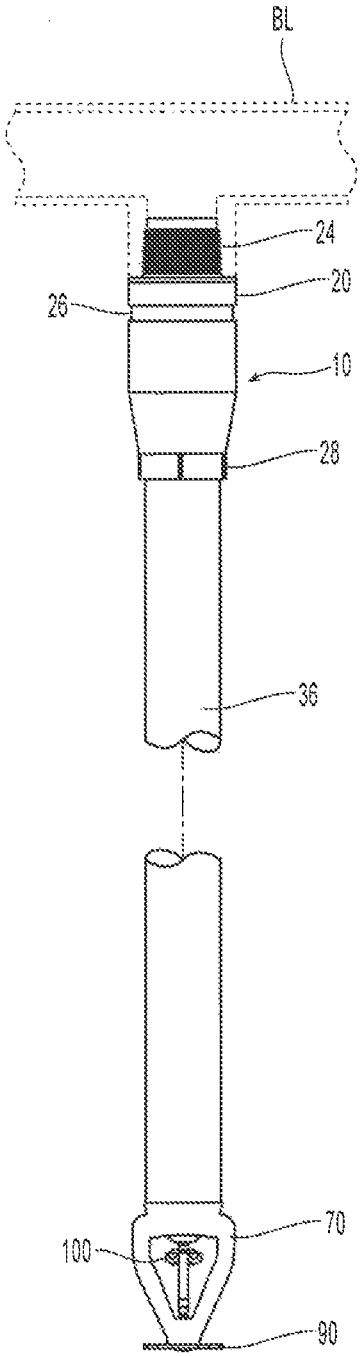
FIG. 1A illustrates a preferred threaded connection of a preferred dry sprinkler using a threaded connection.
Figure 1B:
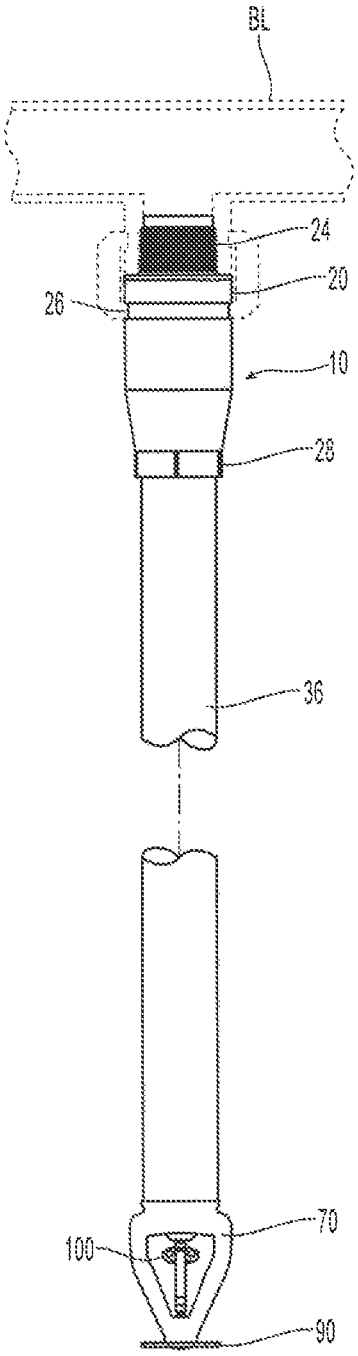
FIG. 1B illustrates a preferred grooved-type coupling connection of the dry sprinkler of FIG. 1A.

Shown in FIG. 1 is a partial detailed perspective view of the dry sprinkler of FIGS. 1A and 1B. More specifically, shown is an inlet fitting 20 of the sprinkler for coupling the dry sprinkler 10 to a fluid supply, such as for example, a branch line BL of a fire protection piping network as shown in FIGS. 1A and 1B. The inlet fitting 20 includes an outer surface 22*a* and an inner surface 22*b*. The inlet fitting outer surface 22*a* preferably includes external fitting threads 24, a clamp groove 26, and a tool engagement portion at the preferably distal end 28 of the fitting 20. The preferred inlet fitting 20 defines a proximal head portion 20*a* that includes the external fitting threads 24 and a larger distal body portion 20*b* that includes the external clamp groove 26. Accordingly, the preferred inlet fitting 20 and its external profile defines a transition between the head and body portions 20*a*, 20*b*. More preferably, the inlet fitting 20 defines a step transition between the fitting threads 24 and the groove 26 that is preferably circularly circumscribed about the axis A-A so as to define a transition portion 34 of the inlet fitting 20 between the head and body portions 20*a*, 20*b*. The clamp groove 26 is preferably disposed distal of the transition portion 34 downstream or distal of the head portion 30 and more preferably distal of the inlet fitting threads 24.

The threads 24 and groove 26 provide the dry sprinkler with a single fitting having preferred alternative coupling arrangements or means for coupling the dry sprinkler 10 to the fluid supply lines BL of a sprinkler system. More specifically, the threads 24 permit the dry sprinkler to be coupled to a fluid supply line by a threaded-type coupling connection, as seen for example, in FIG. 1A. The clamp groove 26 permits the dry sprinkler 10 to be connected to the fluid supply line BL by a groove-type coupling connection, as seen for example, in FIG. 1B. FIGS. 1A and 1B illustrate a preferred installation of the dry sprinkler 10 installed and coupled to a pipe fitting of a piping network, which is supplied with a fire fighting fluid, e.g., fluid from a pressurized fluid supply source. Referring again to FIG. 1, the distal end portion 28 of the fitting 20 includes a tool engagement portion having an exterior shape, e.g., a hexagon, that is suitable for applying, for example, a torque to the inlet fitting 20 when the dry sprinkler 10 is threadably coupled to the piping network via the fitting threads 24. The preferred shape of the inlet fitting 20 with the proximal head portion 20*a* and larger body portion 20*b* defines a tapering profile distal of the groove 26 which tapers toward the casing tube 36.

Figure 2A:
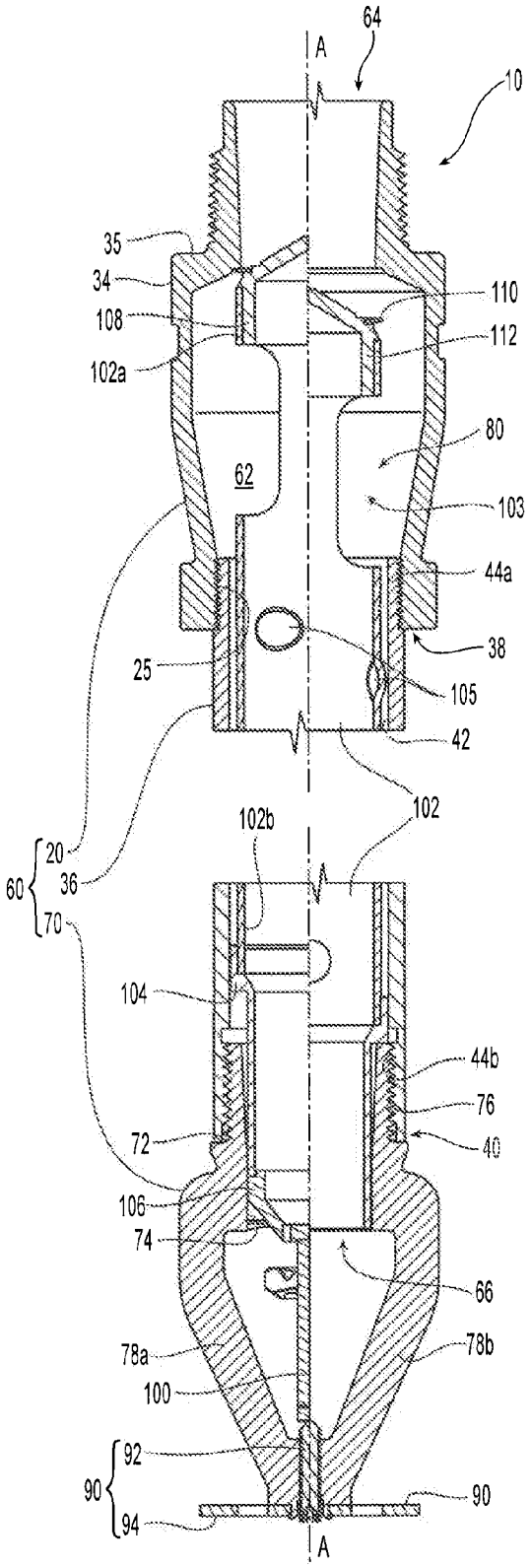
FIG. 2A is a partial cross-sectional views of a preferred embodiment of a dry sprinkler in an unactuated state on one side of axis A-A and in an actuated state on the other side of axis A-A.

Shown in FIG. 2A is a cross-sectional view the dry sprinkler 10 which includes an outer structure assembly 60, an inner structural assembly 80, and a thermal trigger 100. The outer structure assembly 60 defines an internal passageway 62 that extends along a central longitudinal axis A-A between a proximal inlet end 64 and a distal outlet end 66. The outer structure assembly 60 preferably includes the inlet fitting 20 at the proximal end, an outlet frame 70 at the distal end with a casing tube 36 preferably in between to couple the inlet fitting 20 to the outlet frame 70.

For the preferred outer structure assembly 60 of FIG. 2A, the casing tube 36 extends between an inlet fitting end 38 and an outlet frame end 40. The casing tube 36 has a casing tube inner surface 42 that cinctures part of the passageway 62. The casing tube 36 includes proximal coupling threads 44*a* disposed proximate the inlet fitting end 38 and distal coupling threads 44*b* disposed proximate the outlet frame end 40 of the casing tube 36. The proximal coupling threads 44*a* cooperatively engage internal threads 25 at the distal end or inlet fitting 20. The casing tube distal threads 44*b* engage complimentary external threads 76 of the outlet frame 70. Alternatively, the casing tube 36 can be coupled to inlet fitting 20 and outlet frame 70 by any suitable technique, such as, for example, crimping, bonding, welding, or by a pin and groove.

Due to the preferred taper of the outer surface 22*a* of the inlet fitting 20 from the transition portion 34 to the smaller distal end portion 28 and tool engagement portion, the casing tube 22 has a preferably smaller diameter over its length than the transition portion 34. For example, where the transition portion 34 and groove 26 are sized for coupling to a nominal two inch pipe fitting, the casing tube 36 is preferably constructed with a nominal 1½ inch diameter pipe, Schedule 10 galvanized steel pipe. As used herein, "nominal" describes a numerical value, designated under an accepted standard, about which a measured parameter may vary as defined by an accepted tolerance, e.g., Nominal Pipe Size (NPS-in.), Diameter Nominal (DN-mm). Alternatively, the outer surface 22*a* may define alternative profiles over its axial length. For example, the outer surface may define a broadening profile in the proximal to distal direction over the length of the inlet fitting 20.

Further in the alternative, the inlet fitting 20 and the casing tube 36 can be formed as a unitary member such that coupling threads 25 and 44*a* are not utilized. For example, the casing tube 36 can extend as a single tube from the inlet 64 to the outlet 66. Alternatives to the threaded connection to secure the inlet fitting 20 to the casing tube 36 can also be utilized such as other mechanical coupling techniques, which can include crimping or bonding.

Various configurations of the outlet frame 70 can be used with the dry sprinklers 10 according to the preferred embodiments. Any suitable outlet frame 70 may be used so long as the outlet frame 70 positions a fluid deflecting structure 40 preferably axially spaced from the outlet 66 of the dry sprinkler 10 at a preferably fixed distance. The outlet frame 70 has an outlet frame outer surface 71 and an outlet frame inner surface 74 defining an internal bore, which cinctures part of the passageway 62. The outlet frame outer surface 72 can be provided with the external coupling threads 76 formed at a proximal end 32 of the outlet frame 30. The coupling threads 76 preferably cooperatively engage the coupling threads 44*b* of the casing tube 36.

The outlet frame 70 can include at least one frame arm 78 that is coupled to fluid deflecting structure 90. Preferably, the outlet frame 70 and frame arm 78 are formed as a unitary member. The outlet frame 70, frame arm 78, and fluid deflecting structure 90 can be made from rough or fine casting, and, if desired, machined. The fluid deflecting structure 90 may include an adjustment screw 92 and a planar surface member 94 coupled to the frame arm 78 and preferably fixed at a spaced axial distance from the outlet 66. Accordingly, as shown, the preferred outlet frame 70 and deflecting structure 90 provide for a pendent dry sprinkler configuration. The planar surface member 94 is configured to deflect a fluid flow from the sprinkler to form an appropriate spray pattern. Instead of a planar surface member 94, other configurations could be employed to provide the desired fluid deflection pattern. However other deflecting structures and dry sprinkler configurations are possible, such as for example, a sidewall deflector can be used to provide for a horizontal sidewall sprinkler. The adjustment screw 92 is provided with external threads that can be used to adjust axial loading of the inner structure assembly 80 and the thermal trigger 100. The adjustment screw 92 preferably includes a seat portion that engages the thermal trigger 100. Engaged with the outlet frame is a thermal trigger 100 to thermally actuate the sprinkler from an unactuated state. Thermal trigger 100 is preferably a solder link used in combination with a strut and lever. Alternatively, the thermal trigger 100 may be a frangible bulb or any suitable arrangement of components that reacts to the appropriate condition (s) by actuating the dry sprinkler 10.

Referring again to FIGS. 1, 1A and 1B, the preferred pipe transition portion 34 provides a surface 35 that faces, contacts, engages and/or preferably abuts the end of a complimentary grooved pipe or pipe fitting of a fluid supply branch line. More preferably, the surface 35 of the transition portion 34 generally provides a surface that extends substantially perpendicularly to the longitudinal axis A-A of the sprinkler and in one aspect defines a stop surface. Accordingly, the groove 26 is preferably located distally of the stop surface 35, between the stop surface 35 and the distal end portion, so that the dry sprinkler 10 and the mating pipe fitting can be preferably coupled together by commercially available groove-type pipe couplings. Accordingly the transition between the stop surface 35 and the groove 26 may define a variable profile provide it permits for a groove-type coupling. Moreover, the portion of the outer surface of the inlet fitting disposed to each side of the groove 26 defines an axial length and profile to permit the groove-type coupling. As is known in the art, a grooved coupling, such as for example Grinnell Grooved Fire Protection Products, FIG. 772, Rigid Coupling as shown in Tyco Fire & Building Products Technical Data Sheet TFP1950 (July 2004) can be used to couple the inlet fitting 20 with a piping network BL fitting, such as for example, a T-fitting that similarly includes a complimentarily nominally sized pipe groove. For the dry sprinkler 10, the inlet fitting 20 and the clamp groove 26 are sized to a preferred minimum nominal 2 inch size pipe for coupling to a correspondingly sized pipe or pipe fitting. However, the inlet fitting and its clamp groove can be alternatively nominally sized to be smaller or larger. When the inlet fitting and fluid supply pipe fitting form a groove-type pipe coupling connection therebetween, the head portion 20*a* of the inlet fitting 20 proximal to the stop surface 35 is preferably configured for insertion within the inside diameter of the grooved pipe or pipe fitting to which the dry sprinkler 10 is coupled, as seen for example, in FIG. 1B.

The fitting threads 24 of the dry sprinkler 10 are used in forming a preferred threaded connection between the dry sprinkler 10 and a fluid supply piping network BL. In one aspect, the transition portion 34 provides a preferred stop that limits relative threaded engagement between the inlet head 20 and the supply pipe or pipe fitting. The inlet end of the fitting 20 and the threads 24 are preferably configured with American National Standard Taper Pipe Thread (NPT) under ANSI/ASME B1.20.1-1983. For example, the inlet fitting threads 24 are preferably formed as at least one of nominal ¾ inch, 1 inch, 1.25 inch NPT and/or International Standard ISO 7-1 (3*d*. ed., 1994). For a threaded coupling installation as shown for example in FIG. 1A, the fluid supply piping fitting BL may be an internally threaded T-Fitting or union with a nominally sized internal thread for complimentary threaded engagement with the external thread 24. In one particular embodiment of the threaded-type coupling installation, the nominal size of the internal thread of the fluid supply pipe fitting is smaller than the external diameter of the distal body portion 20*b* and more particularly smaller than the external diameter of the transition portion 34. In the case of the preferred groove-type coupling connection, the head portion 20*a* of the inlet fitting 20 is preferably configured for insertion within the inside diameter of the grooved pipe. Accordingly, in one preferred embodiment, the size of the fitting threads 24 are preferably a function of the grooved coupling size. More specifically, the nominal thread diameter of the external threads 24 is maximized yet sized to fit inside a grooved fluid supply pipe or fitting. For example, where the groove 26 of the inlet fitting is sized for coupling to a nominal two inch pipe, the inlet fitting thread 24 is at a maximum 1¼ inch NPT. Accordingly the external thread 24 diameter of the inlet fitting is preferably less than the transition portion 34 external diameter.

Figure 2B:
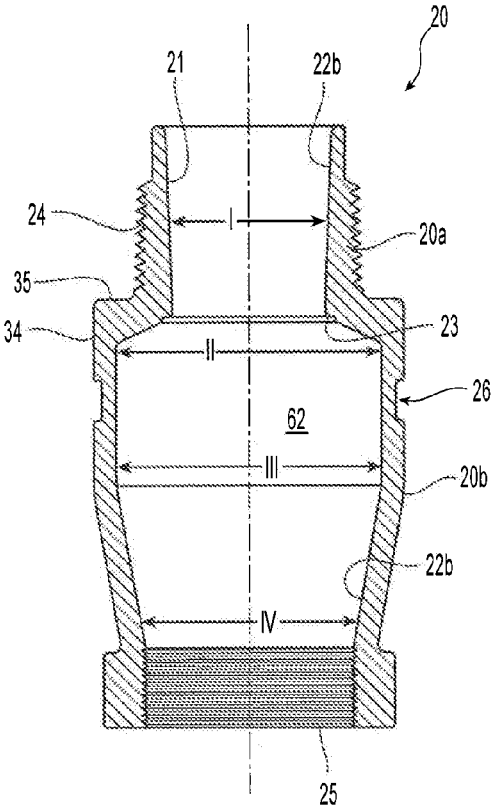
FIG. 2B is a cross-sectional view of the inlet fitting of the dry sprinkler in FIG. 2A.

With reference to FIG. 2B, shown is a cross-section view of the inlet fitting 20. The inlet fitting 20 preferably includes the inner surface 20*b* which cinctures part of the passageway 62 and preferably: (i) defines a preferred entrance surface 21, (ii) defines a sealing surface 23 for contact with an internal sealing assembly in the unactuated state of the dry sprinkler, and/or (iii) defines an internal chamber of the inlet for housing the internal sealing assembly and/or other internal components of the sprinkler when the dry sprinkler 10 is in the actuated state. Features of the inlet fitting inner surface 22*b* and the passageway 62 preferably define two or more sections within the inlet fitting 20 and more preferably define four sections I, II, III and IV that are each cinctured by different surfaces of the inlet fitting inner surface 21. Section I preferably defines the inlet portion of the passageway 62 of the inlet fitting 20 preferably proximal to the transition portion 34 between the entrance surface 21 and the sealing surface 23. Section II preferably defines an expanding region of the passageway to transition distally from Section I between the sealing surface 23 and the widest portion of the interior of the inlet fitting 20 and the passageway 18*a* of Section III of the inlet fitting. Section IV preferably converges in the axial-to-distal direction so as to taper toward the casing tube 36.

The inlet fitting inner surface 22*b* can be alternatively configured provided the resultant profile of the passageway 62 in the inlet fitting 20 facilitates the desired fluid flow therethrough. The inlet entrance surface 21 defines the internal surface profile over which fluid is introduced into the dry sprinkler 10. The inlet entrance surface 21 can define various profiles leading to the sealing surface 23. As shown in FIG. 2B, the inlet entrance surface 21 can be substantially a frustoconical surface disposed about the longitudinal axis A-A that has, in a cross-sectional view, a profile converging towards the longitudinal axis A-A and intersecting the generally planar sealing surface 23. Preferably, the profile is linear; however, the profile could be, for example, stepped. The preferred inlet fitting 20 of FIG. 2B is preferably a singular, integrated piece constructed of a homogenous material cast or forged and machined to include the desired external threads 24 and internal inlet surface 22*b*. The body portion 20*b* preferably is cast or forged and machined to include the external groove 26 for the groove-type coupling, and internally machined to include the internal thread 25 proximate the distal end portion of the inlet fitting 20 along with the surface profile defining the sealing surface 23 and varying sections of the passageway 62.

The location of the sealing surface 23 can define the type of system, wet or dry, to which the dry sprinkler 10 can be preferably coupled to. For example, where the sealing surface 23 of the inlet fitting 20, as shown in FIGS. 2A and 2B, is located at an axial distance below the inlet end of the fitting 20 such that fluid can collect above the sealing surface 23 in the unactuated state of the sprinkler, the dry sprinkler 10 is preferably configured for installation in a wet system. For a preferred nominal two inch (2 in.) diameter transition portion 34, the sealing surface 23 preferably defines a preferred internal opening diameter of about 1¼ inch.

The inner structural assembly 80 of dry sprinkler 10 permits fluid flow between the inlet 64 and the outlet 66. The inner structural assembly 80, preferably, is disposed within the tubular outer structure assembly 60. The terms "tube" or "tubular," as they are used herein, denote an elongate member with a suitable cross-sectional shape transverse to its longitudinal axis, such as, for example, circular, oval, or polygonal. Preferably, each of the inlet fitting 20 and inner structure assembly 80 can be made of a copper, bronze, brass, galvanized carbon steel, carbon steel, or stainless steel material. Moreover, the cross-sectional profiles of the inner and outer surfaces of a tube may be different. According to the preferred embodiment shown in FIGS. 2A and 2B, the inner structural assembly 80 includes a fluid tube 102, a guide tube 104, a trigger seat 106, and a seal assembly 108. In the preferred configuration of the dry sprinkler 10, the seal assembly 108 is engaged with or coupled to the fluid tube 102, and the fluid tube 102 is engaged with or coupled to the guide tube 104, and the guide tube 104 is engaged with or coupled to the trigger seat 106. For the preferred outer structure assembly having the dual connection fitting, any internal assembly may be used provided its operation upon actuation of the dry sprinkler provides a desired flow.

The fluid tube 102 includes a tubular body extending along the longitudinal axis A-A between a seal assembly end 102*a* and a guide tube end 102*b*. The longitudinal length of the fluid tube 102 preferably corresponds to or is substantially the same as that of the casing tube 36. For a preferred nominal 1½ inch casing tube 36, the fluid tube 102 is preferably constructed from 1.125 in. (Inner Diameter)×1.25 in. (Outer Diameter) preferably stainless steel tubing. The overall length of the dry sprinkler 10 can be selected for preferably locating the outlet frame 70 at a desired distance from a fluid supply pipe, for example, a ceiling, a wall, or a floor of an enclosed area. The overall length can be any value, and is preferably between about two to about fifty inches, more preferably ranging from a minimum of about 9 inches to about 48 inches or other fixed length, depending on the application of the dry sprinkler 10. In one embodiment, the casing tube 36 may define a nominal axial length from its proximal end to its distal end ranging from about 1.5 inches to about 40.5 inches.

The fluid tube 102 can include additional features which facilitate flow through the tube and/or assist in maintaining the substantially centered axial alignment of the tube 102 along the passageway 62. The fluid tube 102 preferably includes one or more spaced apart apertures or openings 103 located between the ends of the tube for introducing fluid into the fluid tube 102. In addition, the fluid tube may include one or more surface features which can act against the casing tube 36 to maintain the fluid substantially centrally aligned along the passageway 62. For example, the fluid tube 102 may include one or more spaced apart surface features, projections, dimples, ridges or bumps 105, preferably formed in the tube 102, such that the projection 105 contacts the inner surface of the casing tube 36 to maintain the fluid tube substantially centrally axially aligned within the casing tube 36. The guide tube 104 preferably has an outside diameter sized to smoothly slide in the bore of the outlet frame 70. The guide tube has an inside surface to receive the fluid tube 102 that preferably cinctures the passageway 62. The trigger seat 106 can include a disk member extending along the longitudinal axis A-A that is coupled, e.g., contiguously abuts, the guide tube 104, and the thermal trigger 100.

In an unactuated state of the dry sprinkler 10, the inner structural assembly 80 is supported against a portion of the outer structure assembly 60 so that the seal assembly 108 of the inner structure assembly 80 contacts the sealing surface 23 of the inlet fitting 20. In operation, when the thermal trigger 100 is actuated, the thermal trigger 100 separates from the dry sprinkler 10. The separation of the thermal trigger 100 removes the support for the inner structural assembly 80 against the resilient spring force of the preferred spring seal 110 and/or the pressure of the fluid at the inlet 64. Consequently, the spring seal 110 separates from the sealing surface 23 as the inner structural assembly 80 translates along the longitudinal axis A-A toward the outlet 66 to its fully actuated position, as shown for example to the right of axis A-A of FIG. 2A. The axial force provided by the spring seal 110 assists in separating the inner structural assembly 80 from the sealing surface 23 of the inlet fitting 20. With the seal assembly 108 spaced from the sealing surface 23 and preferably located in Section III of the inlet fitting 20, water or another suitable firefighting fluid is allowed to flow through the inlet 64, through the casing 36 and fluid tube 102, out the outlet 66 and impact the planar surface member 94 or another form of deflector for distribution over a protection area below the dry sprinkler 10. The preferred spring seal 90 is disposed about a mounting member 112 that is preferably fixed to and more preferably at least partially disposed in the proximal end 102*a* of the fluid tube 102.

Figure 3A:
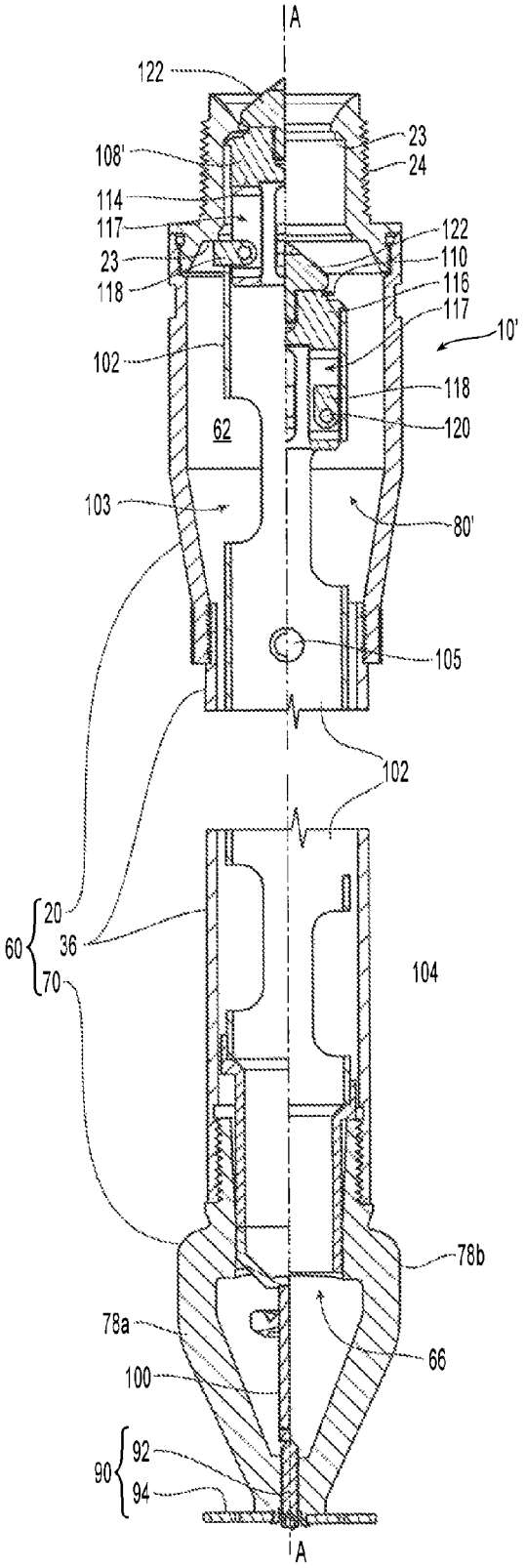
FIG. 3A is a partial cross-sectional view of a dry sprinkler in an unactuated state on one side of axis A-A and in an actuated state on the other side of axis A-A.
Figure 3B:
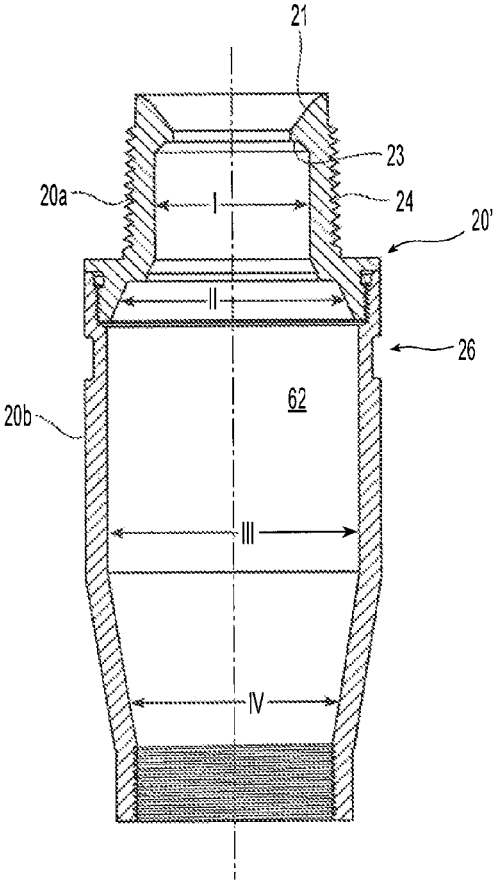
FIG. 3B is a cross-sectional view of the inlet fitting of the dry sprinkler in FIG. 2A.

Shown in FIGS. 3A and 3B is an alternate embodiment of the dry sprinkler 10' in an unactuated and actuated state that is configured for wet or dry system installation. Like reference numerals in FIGS. 3A and 3B refer to like features in FIGS. 2A and 2B. The inlet fitting 20' includes a separate inlet head 20*a* and inlet body 20*b* which are coupled to one another to provide, in combination, the fitting 20 with threads 204 and clamp groove 266 to provide relative threaded engagement between the inlet head 20*a* and the inlet body 20*b*. The inlet fitting 20' includes a preferred inlet entrance surface 21 defines a radiused profile and more preferably a convex profile with respect to the longitudinal axis A-A to form a compound curved surface intersecting a generally planar sealing surface 23.

The dry sprinkler 10' is shown with the inlet fitting 20' of FIG. 3A in which the sealing surface 23 is located axially proximal to or substantially adjacent to the inlet fitting threads 24 in Section I and more specifically between the entrance surface 21 and the axial start of the fitting threads 24. Because the preferred configuration of the inlet fittings threads 24 define the minimum diameter of the inlet fitting 20', the sealing surface 23 diameter is minimized. For a maximum nominal pipe thread diameter of 1¼ inch diameter of the fitting thread 24, the sealing surface 23 defines a preferred internal opening in the sealing surface with a diameter of about one inch (1 in.). Accordingly, to properly locate the seal assembly 108' within the preferred Section III inlet fitting 20, the seal assembly requires a longer axial displacement from the sealing surface 23 as compared to the dry sprinkler 10 embodiment of FIGS. 1C.

To provide the desired axial displacement of the seal assembly 108', the dry sprinkler 10 includes a contractible inner assembly 80' in which the seal assembly 108' preferably includes a yoke sub-assembly 114. The yoke sub-assembly 114 preferably provides for relative axial displacement between the seal assembly 108' and the fluid tube 102. The yoke subassembly 114 is preferably configured with the mounting portion 116 with four levers 118 pivotally coupled to the mounting member 116 by, for example, four respective dowel pins 120, the diverter 122 and the spring seal 110. The mounting portion 116 includes a tubular body with a plurality of windows or openings 117 distributed about its periphery. Each window 117 provides an opening to a chamber in the tubular body 612.

Preferably, each lever 118 between a first orientation in which the lever 118 extends substantially perpendicular to the longitudinal axis A-A in the unactuated state of the sprinkler 10' of FIG. 3A, to a second orientation in which the lever 118 is substantially parallel to the longitudinal axis A-A in the actuated state of the sprinkler 10'. The levers 118 are placed in their first orientation by contact with the sealing surface 23 of the inlet fitting 20'. The levers first orientation support the yoke assembly atop the fluid tube 102 such that the seal spring 110 is in contact with the sealing surface 23. In the unactuated state of the dry sprinkler 10', as seen to the left of axis A-A of FIG. 3A, the diverting element 122 extends above the sealing surface 23 substantially adjacent the inlet and proximal end of the fitting 20. In the actuated arrangement of the dry sprinkler 10' operation of the thermal trigger 100 causes an initial axial displacement of the inner structural assembly 80' along the longitudinal axis A-A toward the outlet 66. The preferred axial displacement is defined by the axial length between the top of the outlet frame 70 and the proximal end of the guide tube 104 in the unactuated state of the sprinkler 10'. This initial movement permits the levers 118 to disengage from the surface 23 of the inlet 20, allowing the levers to pivot about their axes into their second orientation and into their respective openings 117 in the body 116. The contraction or collapse of the levers 118 into the channels axially displace the yoke sub-assembly 114 along the longitudinal axis A-A relative to the fluid tube 102. More specifically, the levers 118 pivot so as to remove support of the yoke 114 such that the yoke is axially displaced within the tube 102. A travel stop of the mounting portion 116 contacts the top or proximal end of the fluid tube 102 to limit the distance that the yoke sub-assembly 114 is permitted to travel inside the fluid tube 102. Accordingly, the axial distance between the travel stop of the mounting portion 116 and the proximal end of the fluid tube 102 in the unactuated state of the sprinkler 10 defines the axial travel of the yoke subassembly 114 relative to the fluid tube 102 upon actuation of the sprinkler 20'.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A dry sprinkler comprising:

an outer structural assembly having a proximal inlet, a distal outlet, and an internal passageway extending between the inlet and the outlet defining a longitudinal axis of the sprinkler, the outer structural assembly including:

an inlet fitting including a proximal head portion and a distal body portion, the head portion having an external thread defining a nominal external thread diameter, the body portion including an external groove defining a nominal groove diameter being greater than the nominal external thread diameter, the external thread and groove providing the sprinkler with alternate threaded and grooved coupling arrangements for connection to a fluid supply pipe, the inlet fitting having an internal surface with four sections, each of the four sections defining a different portion of the internal passageway, the first section defining an inlet portion with a sealing surface of the dry sprinkler, the second section defining an expanding region of the internal passageway to a third portion that defines the widest portion of the internal passageway, and a fourth portion that converges the internal passageway in an axial-to-distal direction, inlet fitting having an outer surface portion that forms a transition between the proximal head portion and the distal body portion to define a transition portion between the external thread and the external groove, the transition portion defining a stop surface;

an outlet frame including a deflector axially spaced at a fixed distance from the outlet; and a casing tube disposed between the inlet fitting and an outlet frame;

a seal assembly disposed along the passageway for contacting the sealing surface; and a thermal trigger for supporting the seal assembly against the sealing surface in an unactuated state of the dry sprinkler.

2. The dry sprinkler of claim 1, wherein the transition defines a step transition between the external thread and the external groove, the step transition defining the stop surface that extends substantially perpendicularly to the longitudinal axis of the axis.

3. The dry sprinkler of claim 1, wherein the external groove defines a nominal two inch diameter and the casing tube defines a nominal 1½ inch.

4. The dry sprinkler of claim 1, wherein the external groove defines a nominal two inch diameter and the external thread defines a nominal thread of any one of a nominal ¾ inch, 1 inch, and 1¼ inch NPT.

5. The dry sprinkler of claim 1, wherein the seal assembly is supported by an internal assembly having a fluid tube, a guide tube and trigger seat supported by the thermal trigger in the unactuated state of the sprinkler, the fluid tube including a plurality of apertures and a plurality of projections.

6. The dry sprinkler of claim 1, wherein sprinkler defines a sprinkler axial length ranging from about 9 inches to about 48 inches.

7. The dry sprinkler of claim 1, wherein the distal body portion defines an external diameter of about two inches, and the sealing surface defines an internal opening diameter of about 1¼ inch.

8. The dry sprinkler of claim 1, wherein the external thread extends proximally of the sealing surface.

9. The dry sprinkler of claim 1, wherein the external thread extends distally of the sealing surface.

10. The dry sprinkler of claim 1, wherein the distal body portion of the inlet fitting includes an outer surface distal of the external groove that tapers toward the casing tube.

11. The dry sprinkler of claim 1, wherein the casing tube defines a nominal 1½ inch.

12. A system for connecting a dry sprinkler to a fluid supply pipe, the system comprising:

a fluid supply pipe fitting; and a dry sprinkler having an inlet fitting, an outlet frame and a casing tube between the inlet fitting, and the outlet frame to define a passageway of the sprinkler, the inlet fitting including a proximal head portion and a distal body portion with a transition portion between the proximal head and distal body portions, the head portion having an external thread, the body portion including an external groove, the sprinkler including an internal assembly to seal the passageway at the inlet fitting, and one of a threaded-type coupling connection and a grooved-type coupling connection between the inlet fitting and the fluid supply pipe fitting, wherein in the threaded-type coupling connection, the fluid supply pipe fitting is an internally threaded fitting, the external threads being threaded into the threaded pipe fitting; and wherein in the grooved-type coupling connection, the fluid supply pipe fitting is a grooved fitting coupled to the external groove of the inlet fitting with the external thread being substantially disposed within the grooved fitting; and wherein the inlet fitting comprises an internal surface with four sections, each of the four sections defining a different portion of the internal passageway, the first section defining an inlet portion with a sealing surface of the dry sprinkler, the second section defining an expanding region of the internal passageway to a third portion that defines the widest portion of the internal passageway, and a fourth portion that converges the internal passageway in an axial-to-distal direction, and inlet fitting having an outer surface portion that forms a transition between the proximal head portion and the distal body portion to define a transition portion between the external thread and the external groove, the transition portion defining a stop surface.

13. The system of claim 12, wherein the external thread defines a nominal external thread diameter and the external groove defines a nominal groove diameter being greater than the external thread diameter.

14. The system of claim 12, wherein the distal body portion of the inlet fitting includes an outer surface distal of the external groove that tapers toward the casing tube.

15. The system of claim 12, wherein the casing tube defines a nominal diameter of 1½ inch.

16. The system of claim 12, wherein the transition portion defines an external diameter of about two inches, and the sealing surface defines an internal opening diameter of about 1¼ inch.

17. A method of coupling a dry sprinkler to a fluid supply pipe, the dry sprinkler having an inlet fitting, an outlet frame and a casing tube between the inlet fitting, and an internal assembly to seal the passageway at the inlet fitting, the method comprising:

disposing the inlet fitting of the dry sprinkler along the fluid supply pipe, the inlet fitting having a proximal head portion and a distal body portion, the body portion including a transition portion between the proximal head and distal body portions, the head portion having an external thread, the body portion including an external groove;

forming one of a threaded-type coupling connection and a grooved-type coupling connection between the inlet fitting and a fluid supply pipe fitting, wherein forming the threaded-type coupling connection includes threading the external threads to an internally threaded pipe fitting; and wherein forming the grooved-type coupling connection includes coupling the external groove of the inlet fitting to a grooved fluid supply pipe fitting and disposing the external thread within the grooved fluid supply pipe fitting; and wherein the inlet fitting comprises an internal surface with four sections, each of the four sections defining a different portion of the internal passageway, the first section defining an inlet portion with a sealing surface of the dry sprinkler, the second section defining an expanding region of the internal passageway to a third portion that defines the widest portion of the internal passageway, and a fourth portion that converges the internal passageway in an axial-to-distal direction, and inlet fitting having an outer surface portion that forms a transition between the proximal head portion and the distal body portion to define a transition portion between the external thread and the external groove, the transition portion defining a stop surface.

18. The method of claim 17, wherein forming the threaded connection includes engaging the transition portion with the threaded pipe fitting.

19. The method of claim 17, wherein forming the grooved-type connection includes engaging the transition portion with the grooved pipe fitting.

* * * * *